United States Patent [19]

Martinez Sanz

[11] Patent Number: 4,471,598

[45] Date of Patent: Sep. 18, 1984

[54] DEVICE FOR INSERTING LETTERS IN ENVELOPES

[76] Inventor: José A. Martinez Sanz, Emérita Agusta, 2, Barcelona, Spain

[21] Appl. No.: 463,543

[22] Filed: Feb. 3, 1983

[30] Foreign Application Priority Data

Feb. 3, 1982 [ES] Spain ..... 262.949[U]

[51] Int. Cl.[3] ..... B65B 43/26; B65B 43/14

[52] U.S. Cl. ..... 53/266 A

[58] Field of Search ..... 53/266 A, 460, 570, 53/384, 459, 492

[56] References Cited

U.S. PATENT DOCUMENTS

| | | | |
|---|---|---|---|
| 2,839,880 | 6/1958 | Boughton | 53/266 A X |
| 3,936,993 | 2/1976 | Dorer | 53/266 A |
| 4,079,576 | 3/1978 | Morrison et al. | 53/266 A |

FOREIGN PATENT DOCUMENTS

| | | | |
|---|---|---|---|
| 1045672 | 10/1966 | United Kingdom | 53/266 A |

*Primary Examiner*—Horace M. Culver

*Attorney, Agent, or Firm*—Wenderoth, Lind & Ponack

[57] ABSTRACT

A device for inserting letters into envelopes includes an outlet ramp on an extractor of a letter folding machine situated above an ascending ramp along which an envelope originating from a conventional feeder moves upwards. The ramp is oscillating at its lower end mid-portion wherefore it is brought closer to or is separated from the ramp of the extractor. The oscillating ramp is preferably activated by an electromagnet which releases the envelope during its discharge from the feeder, bringing the ramps closer together and arranging another envelope when it is positioned in front of the ramp of the extractor of the letter-folding machine. The oscillating ramp is provided with three tangential rollers fixed thereto and below the ramp, the two end rollers whereof projecting to the envelope receiving surface, the anterior being situated immediately below a folded letter inlet roller pertaining to the letter extracting ramp, while the other roller is situated below the envelope which is pressed against the oscillating ramp by the action of springs with the flap situated below the folded letter extracting ramp.

6 Claims, 4 Drawing Figures

DEVICE FOR INSERTING LETTERS IN ENVELOPES

The present invention refers to an improved device for inserting letters in envelopes.

In large-sized companies having abundant correspondence the task of folding the letters, inserting them in envelopes and closing the envelope occupies a substantial time in hand labour, which negatively affects the production costs.

To reduce the mentioned costs, there exist in the market numerous machines which, in a more or less automatic manner, carry out this task. Nevertheless, the effectiveness and security proportioned thereby are not completely reliable and the attention of a person is frequently necessary to correct the possible mistakes mainly at the time of inserting the letter in the envelope, which mistakes are caused by the frequent deviations of the envelope or letters themselves during the operation of the machine.

In order to offer the market with an advantageous solution, from a technical and commercial point of view, the letter-inserting device in question is specially designed to facilitate this task as much as possible in a simple and effective manner, using simple and economical mechanisms which provide the device with a practical and competitive assembly.

Thus, the device for inserting letters in envelopes of the present invention is disposed in transference with the extractor of a letter-folding machine, the outlet ramp of the extractor of the letter-folding machine being situated above an ascending ramp along which the envelope moves from a conventional feeder.

Said ramp is oscillating at its lower end mid-portion, wherefore it is brought closer to or separated from the ramp of the extractor, the oscillating ramp being preferably activated by an electromagnet which releases the envelop during it discharge from the feeder, bringing the ramps closer together and arranging another envelope when it is situated in front of the ramp of the extractor of the letter-folding machine.

The oscillating ramp has been provided with three tangential rollers fixed thereto and below the ramp, of which the two end rollers project to the envelope receiving surface, the anterior being situated immediately below a folded letter inlet roller, said roller pertaining to the letter extracting ramp, while the other roller is situated below the envelope which is pressed against the oscillating ramp by the action of springs, the flap of which is situated below the extracting ramp of the folded letters offering its mouth to said ramp.

Both ramps form a concave dihedral, at the inner edge of which there is positioned the mouth of the envelope interrupting the passage of the folded letter which is driven by the extracting rollers towards the oscillating ramp, in which there is provided an end-of-stroke contact which acts on the electromagnet and separates both ramps, disconnecting tangentially the extracting roller from the train of rollers situated above and below the oscillating ramp.

The three tangential rollers are activated by the first one of them from a letter extracting roller, said roller being the last of the folded letter extracting ramp, which is situated on the vertex of the concave dihedral formed by both ramps.

The end of stroke contact which acts on the electromagnet and separates both ramps is disposed in a bridge which can slide along said ramp and can be positioned on relative points thereof, depending on the width of the envelope which is arranged, together with its flap, below the letter extracting ramp and interrupts, with its mouth, the passage of said letters when folded they move along the extracting ramp.

To conveniently illustrate the aforegoing, there is accompanied to this specification forming an integral part thereof, a set of drawings wherein three has been represented schematically an illustrative but not limiting example of the practical possibilities of the invention.

Figure 1:
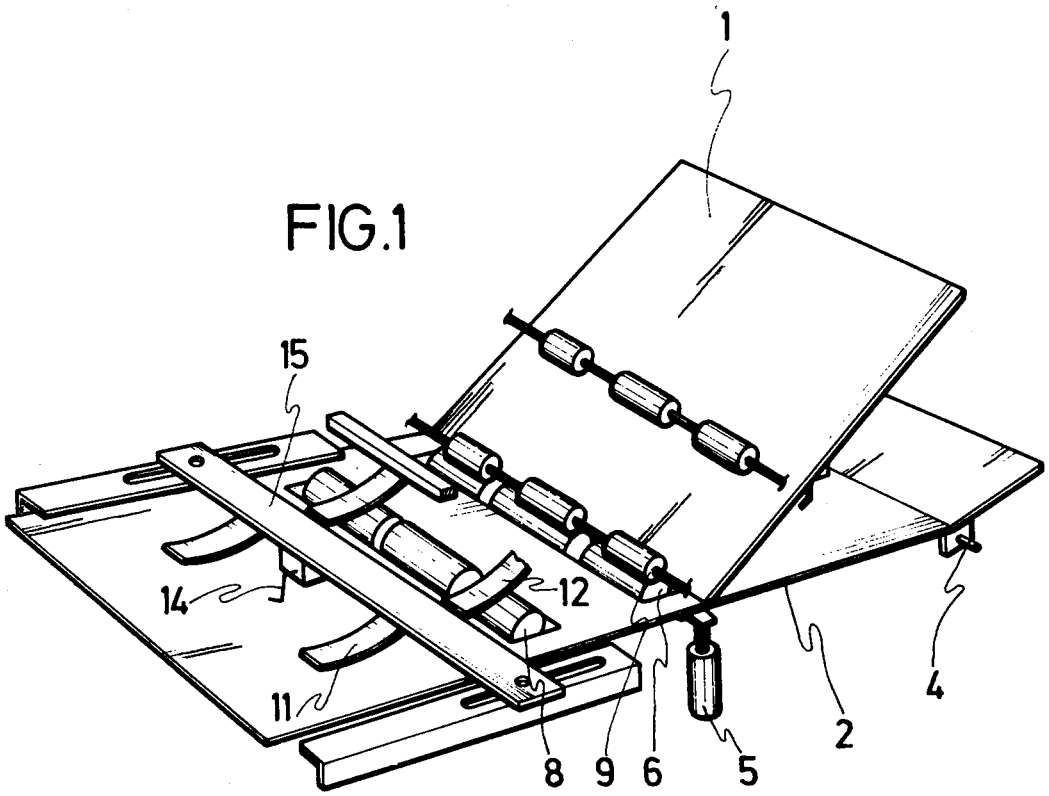
FIG. 1 represents a perspective view of the assembly, illustrating the main elements of which the device is comprised.
Figure 2:
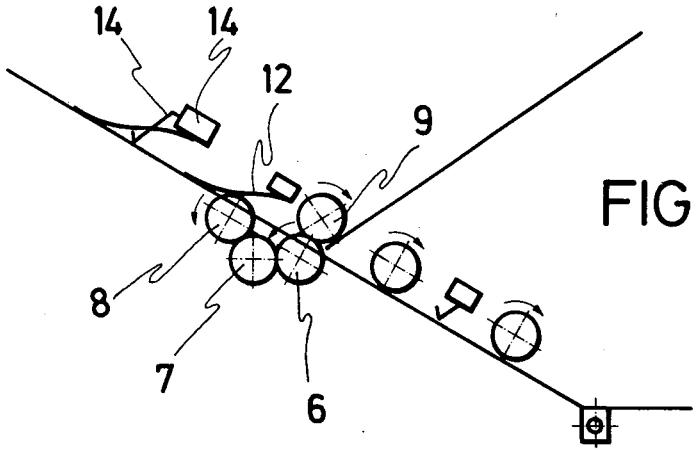
FIG. 2 illustrates a partial profile view, showing in detail the zone where the letter is inserted in the envelope.

Referring to these figures, there are referenced; 1 outlet ramp of the extractor, 2 ascending ramp, 3 envelope, 4 lower end mid-portion of the ascending ramp, 5 electromagnet, 6, 7 and 8 tangential rollers, 9 inlet roller, 10 letter, 11 and 12 springs, 13 flap of the envelope, 14 end of stroke contact, and 15 slidable bridge.

Once the letter 10 has been folded in the corresponding machine, it is moved along the outlet ramp of the extractor 1 of said folding machine towards the inserter device. The mentioned ramp 1 is situated above the ascending ramp 2 along which the envelope 3 coming from a conventional type feeder moves.

The ascending ramp 2 oscillates about the lower end mid-portion 4 wherefore it is brought closer to or separated from the ramp of the extractor 1, which oscillation is activated by the electromagnet 5 which is controlled by the passage of the envelopes 3 themselves, so that an envelope when reaching the end of stroke contact 14 acts on the electromagnet 5 and when the descent of the ramp 2 is produced, interrupts the transmission of the inlet roller 9 which moved the tangential rollers 6, 7 and 8, whereby the envelope is stopped at a point whereat its mouth is situated in the passage of the letter 10 and its flap 13 is below the ramp of the extractor 1.

Positioning of the envelope 3 at the point where it receives the letter 10 is assured by the springs 11 and 12. The springs 11 and the end-of-stroke contact 14 are mounted on a bridge 15 which is slidable along the ascending ramp 2 to be positioned, depending on the width of the envelope 3, in order to suitably position the mount of said envelope 3 in the passage of the letter 10.

Figure 3:
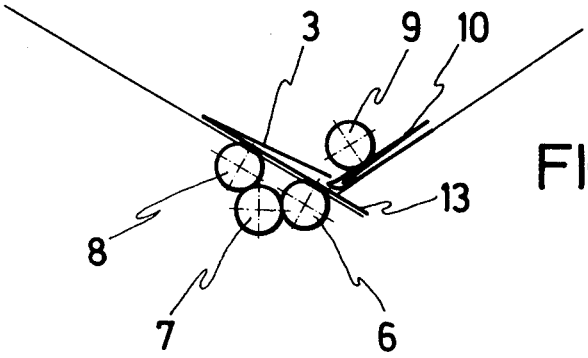
FIG. 3 illustrates a detail of the arrangement and movement of the letter with respect to the envelope at the moment at which the envelope receives the letter.
Figure 4:
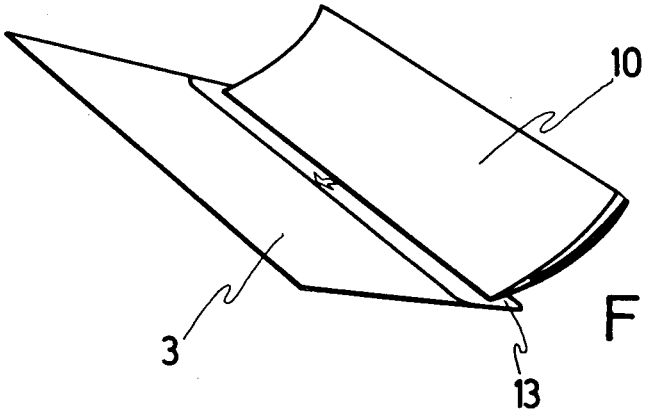
FIG. 4 illustrates a perspective view of the envelope and the letter, as arranged at the time the letter is inserted in the envelope.

When the envelope 3 is blocked at the previously mentioned point as represented in FIG. 3, a folded letter 10 reaches same which is moved by the roller 9 towards the interior of the envelope. Thereafter another envelope moves upwards along the ramp 2 and said envelope is detected by a sensor which activates the electromagnet 5 causing the ramp 2 to ascend, whereby the train of rollers 6, 7 and 8 receives the movement of the roller 9, releasing the envelope 3 together with its letter 10 and positioning the mouth of another envelope in the passage of another letter.

I claim:

1. An apparatus, adapted to be used in conjunction with the extractor of a letter folding machine, for inserting folded letters into corresponding envelopes, said apparatus comprising:

a downwardly inclined outlet ramp guiding downward movement therealong of folded letters received from a letter folding machine;

an upwardly inclined oscillating ramp positioned beneath said outlet ramp and extending at an angle with respect thereto;

means for feeding envelopes one-at-a-time upwardly along said oscillating ramp, with the closed bottom of each of said envelope directed forwardly, with the mouth thereof facing upwardly and with the open flap thereof directed rearwardly, to a position beneath the bottom of edge of said outlet ramp;

a driven inlet roller mounted at a position adjacent the bottom of said outlet ramp and above said oscillating ramp;

idler roller means mounted on said oscillating ramp for cooperation with said driven inlet roller to move said envelopes upwardly along said oscillating ramp from said position beneath said bottom edge of said outlet ramp;

means, positioned along said oscillating ramp, for detecting when an envelope has been moved therealong to an inserting position such that the open flap thereof is located beneath said bottom edge of said outlet ramp and the mouth thereof is positioned in the path of a folded letter moving downwardly along said outlet ramp;

means, operable by said detecting means, for, upon said envelope inserting position being detected thereby, oscillating said oscillating ramp from a first position, whereat said driven inlet roller and said idler roller means cooperate to move the envelope, to a second position, whereat said idler roller means is spaced from and moved out of cooperation with said driven inlet roller, and thereby for stopping the envelope at said inserting position thereof;

whereafter continued rotation of said driven inlet roller drives a folded letter along said bottom of said outlet ramp and forces the folded letter through the angle between said bottom of said outlet ramp and said oscillating ramp and into the open mouth of the envelope; and means for, upon the folded letter being inserted into the envelope, moving said oscillating ramp from said second position thereof to said first position, whereat said idler roller means again cooperates with said driver roller means to continue moving the filled envelope upwardly along said oscillating ramp.

2. An apparatus as claimed in claim 1, wherein said idler roller means comprises a rearward idler roller located to be contacted and driven by said inlet roller when said oscillating ramp is in said first position thereof, a middle idler roller in contact with said rearward idler roller, and a forward idler roller in contact with said middle idler roller.

3. An apparatus as claimed in claim 1, further comprising spring means mounted on said oscillating ramp for pressing the envelope thereagainst.

4. An apparatus as claimed in claim 1, wherein said detecting means comprises a contact positioned to be abutted by the forwardly directed bottom of the envelope.

5. An apparatus as claimed in claim 4, wherein said oscillating means comprises a solenoid electrically connected to said contact.

6. An apparatus as claimed in claim 4, further comprising a bridge adjustably mounted on said oscillating ramp for movement longitudinally thereof, said contact being mounted on said bridge, whereby the longitudinal position of said contact is adjustable to accommodate envelopes of varying sizes.

* * * * *